US008049123B2

(12) United States Patent
Hou et al.

(10) Patent No.: US 8,049,123 B2
(45) Date of Patent: Nov. 1, 2011

(54) COMPUTER INPUT DEVICE AND WATERPROOF BUTTON MECHANISM THEREOF

(75) Inventors: Ding-Teng Hou, Sanchung (TW); Zai-Fu Yang, Sanchung (TW)

(73) Assignee: Kye Systems Corp., San Chung, Taipei Hsien (TW)

( * ) Notice: Subject to any disclaimer, the term of this patent is extended or adjusted under 35 U.S.C. 154(b) by 252 days.

(21) Appl. No.: 12/585,987

(22) Filed: Sep. 30, 2009

(65) Prior Publication Data

US 2011/0042192 A1 Feb. 24, 2011

(30) Foreign Application Priority Data

Aug. 20, 2009 (TW) ..... 98127967 A

(51) Int. Cl.
*H01H 13/06* (2006.01)

(52) U.S. Cl. ..... 200/302.2

(58) Field of Classification Search ..... 200/302.1, 200/302.2

See application file for complete search history.

(56) References Cited

U.S. PATENT DOCUMENTS

| | | | | |
|---|---|---|---|---|
| 7,034,238 | B2 * | 4/2006 | Uleski et al. | 200/500 |
| 7,705,258 | B2 * | 4/2010 | Geldmacher | 200/341 |
| 7,764,936 | B2 * | 7/2010 | Nakasono et al. | 455/128 |
| 2007/0227866 | A1 * | 10/2007 | Dimig | 200/302.2 |
| 2007/0270013 | A1 * | 11/2007 | Clark | 439/346 |

* cited by examiner

*Primary Examiner* — Vanessa Girardi
(74) *Attorney, Agent, or Firm* — Bacon & Thomas, PLLC

(57) ABSTRACT

A waterproof button mechanism of a computer input device has a bottom case having a coding module and at least two micro switches mounted therein and connected with the inner case. Two mounting holes are formed on a front end of the inner case to respectively correspond to the two micro switches on the bottom case. Two waterproof assemblies are respectively mounted on the two mounting holes. A top cover is mounted on the inner case. Two slots are formed through a front end of the top cover. A button is movably mounted in the slot and a front end of the button corresponds to the waterproof assembly. When the button is pressed down, the input device is operated by triggering the micro switches through the waterproof assembly. The waterproof mechanism is waterproof function to be added without sacrificing easy customization of appearance.

12 Claims, 7 Drawing Sheets

COMPUTER INPUT DEVICE AND WATERPROOF BUTTON MECHANISM THEREOF

BACKGROUND OF THE INVENTION

1. Field of the Invention

The present invention is related to a computer input device, and more particularly to a waterproof button mechanism of a computer input device.

2. Description of the Related Art

By and large, the cases of current optical mice are seemingly sealed, but not yet completely sealed to prevent water penetration due to buttons and scroll-wheel of the mice. As most mice having scroll-wheel and buttons located in the front end of the mice pertain to a mechanical type, gaps between button and case and between scroll-wheel and case become the places in which water penetrates. Currently, regarding the scroll-wheel, there have been touch-type products as alternatives. Such touch-type products determine moving changes of the scroll-wheel in accordance with touching directions of users. Although such products remove some gaps in the case, gaps between the buttons and the case still exist. To tackle these problems, waterproof mechanism for buttons of conventional mice mostly adopt a waterproof measure as shown in FIG. 7. The waterproof measure employs rubber to completely sheathe a case (70) of the mouse and a top cover in particular so as to obviate gaps between the case and buttons located in the front end of the conventional mice. Despite a solution to the waterproof issue, such approach adopting rubber to fully enclose the case greatly reduces flexibility in appearance of mice. As far as information products are concerned, functions and ornamental design are equally important. Such approach apparently fulfills one at the cost of the other.

SUMMARY OF THE INVENTION

An objective of the present invention is to provide a waterproof button mechanism of a computer input device. Such waterproof button mechanism provides a waterproof function under a conventional button mechanism and maintains flexible choices of ornamental design, thereby simultaneously taking waterproof function and ornamental design into account.

To achieve the foregoing objective, the waterproof button mechanism of computer input device has a bottom case, an inner case and two buttons.

The bottom case has a first opening, a bottom edge formed around the first opening, and two micro switches mounted therein and located on a front end thereof.

The inner case has a second opening, an inner edge formed around the second opening to correspond to the bottom edge and connected with the bottom case, two mounting holes formed on a front end thereof and corresponding to two micro switches on the bottom case, and two waterproof assemblies respectively mounted to cover the two mounting holes and each having a cap gasket being resilient vertically and aligned to the corresponding micro switch thereunder.

Two buttons are movably mounted above the inner case and each have a front end corresponding to one of the respective cap gaskets on the inner case.

Given the aforementioned mechanism, the only gap between the bottom case and the inner case is the mounting hole on the inner case. The mounting hole is sealed with the waterproof assembly. A water-sealing condition is present between the bottom case and the inner case. The button corresponds to the waterproof mechanism on the inner case. When the button is pressed down, the button indirectly triggers the micro switch through the waterproof mechanism on the inner case. Because the inner case and the bottom case are completely sealed, the waterproof objective can be attained. Besides being waterproof, the present invention employs a basic structure of a conventional computer input device and adopts a special design so that the waterproof mechanism can be mounted in the mouse without affecting other parts. Accordingly, the waterproof mechanism of computer input device of the present invention can still maintain diversified spatial selections in terms of ornamental design.

DETAILED DESCRIPTION OF THE INVENTION

Figure 1:
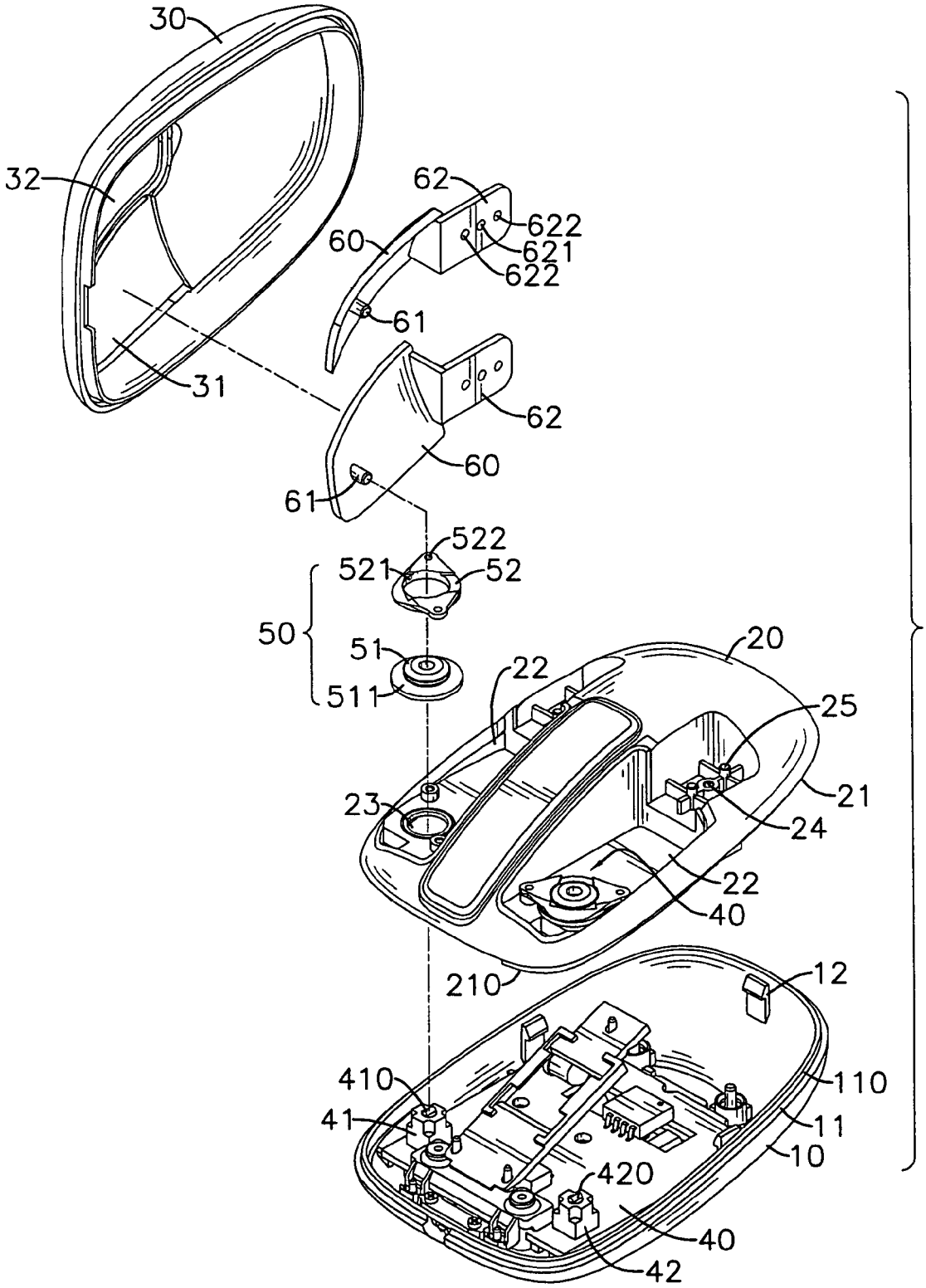
FIG. 1 is an exploded perspective view of a first preferred embodiment of a waterproof button mechanism in accordance the present invention.

Computer input devices mentioned in the present invention are not limited to a mouse, keyboard, trackball, game controller and the like. With reference to FIG. 1, a first embodiment of a waterproof button mechanism in accordance with the present invention has a bottom case (10), an inner case (20) and a top cover (30).

The bottom case (10) has a first opening. A bottom edge (11) is formed around the first opening. A bottom rib ring (110) is formed on an inner side of the bottom edge (11) and extends upwardly, serving to be connected with the inner case (20) and a top cover (30). A coding module (40) and at least two micro switches (41, 42) are mounted in the bottom case (10). As known in the art, a bottom of the bottom case (10) should be partially pervious to light. The two micro switches (41, 42) are located at positions abutting two sides of a front end of the bottom case (10). Two actuation protrusions (410, 420) are respectively mounted on the two micro switches (41, 42). In the present embodiment, three hooks (12) are respectively mounted on a rear position and two side positions of an inner wall of the bottom case (10), so the bottom case (10) is locked with the inner case (20).

Figure 2:
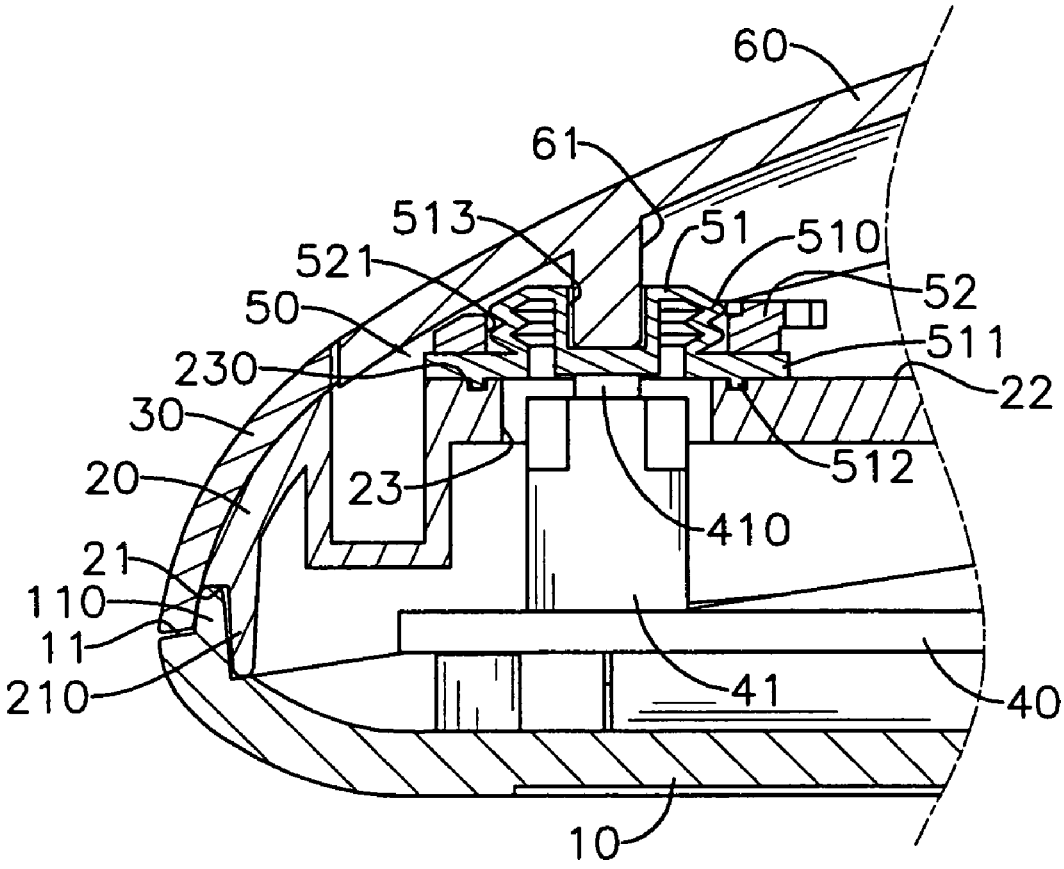
FIG. 2 is a partial cross-sectional view of the first preferred embodiment of the waterproof button mechanism in accordance with the present invention.
Figure 3:
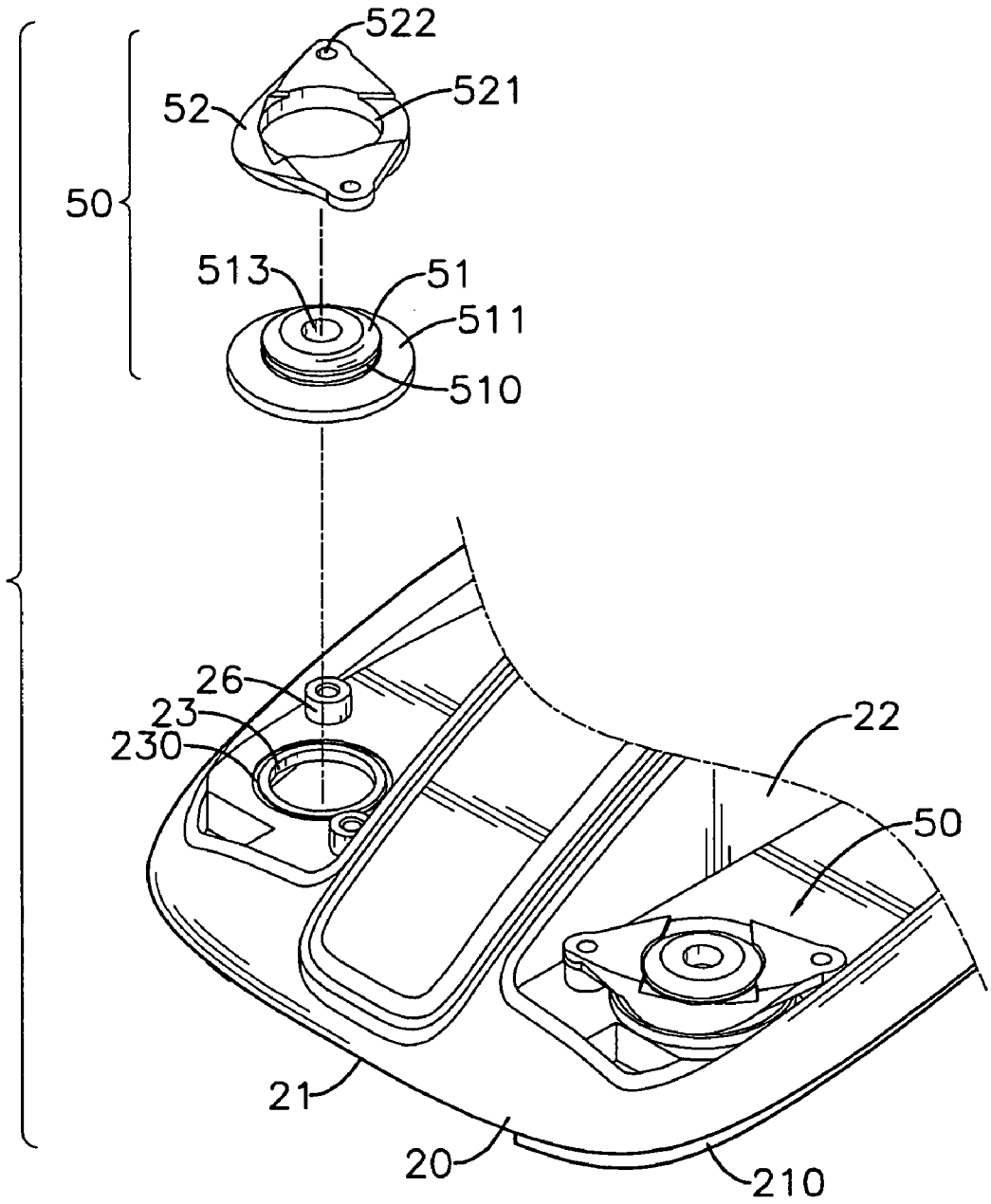
FIG. 3 is a partial exploded perspective view in FIG. 1.

The inner case (20) has a second opening and has a transverse axis and a longitudinal axis. The transverse axis is longer than the longitudinal axis. An inner edge (21) is formed around the second opening. An inner rib ring (210) is formed on an inner side of the inner edge (21) and extended downwardly. The outer perimeter of the inner rib ring (210) matches the inner perimeter of the bottom rib ring (11) so that the bottom case (10) and the inner case (20) can be closed together as shown in FIG. 2. Two recesses (22) are respectively formed on two ends of the longitudinal axis of the inner case (20) and are in parallel with the transverse axis of the inner case (20). Each of the two recesses (22) has a mounting hole (23) formed on a front end thereof. An annular groove (230) is formed on an outer periphery of the mounting hole (23). A first fixing column (24) and two positioning bosses (25) are formed on a rear end of every one of the two recesses (22). The two mounting holes respectively correspond to the two micro switches (41, 42). Two waterproof assemblies (50) are respectively mounted on the two mounting holes (23). With reference to FIGS. 2 and 3, the waterproof assembly (50) has a hollow cap gasket (51). In the present embodiment, an elastic portion (510) in the form of a flexible pipe is formed on an outer periphery of the cap gasket (510), enabling the cap gasket (510) to be resilient and preventing the cap gasket (510) from cracking due to prolonged compression. A disk portion (511) is extended horizontally and outwardly from a bottom of the cap gasket (51). A waterproof ring (512) protrudes downwardly from a bottom of the disk portion (511). The outer diameters of the disk portion (511) and the waterproof ring (512) are greater than the diameter of the mounting hole (23). A height of the waterproof ring (512) corresponds to a depth of the annular groove (230) to ensure a tight engagement. When the cap gasket (51) covers on the mounting hole (23), the waterproof ring (512) is engaged in the annular groove (230) and the disk portion (511) is flatly attached on the recess (22) to provide a good sealing effect. Meanwhile, the cap gasket (51) corresponds to the actuation protrusions (410, 420) on the two micro switches (41, 42).

To further secure stable and correct motion of the mounted cap gasket (51), the waterproof assembly (50) further has an eye-shaped gasket fixing seat (52). With further reference to FIGS. 2 and 3, a bore (521) is formed through the gasket fixing seat (52), and the bore diameter matches the outer diameter of the cap gasket (51) such that the cap gasket (51) can penetrate the bore (521) in from an inner to an outer direction. The gasket fixing seat (52) has a transverse axis and a longitudinal axis, and the transverse axis is longer than the longitudinal axis. Two first fixing holes (522) are formed through two ends of the gasket fixing seat (52) along the transverse axis of the gasket fixing seat (52). Two second fixing columns (26) are mounted on the recess (22) to abut the mounting hole (23) therein and respectively correspond to the two fixing holes on the gasket fixing seat (52) for the gasket fixing seat (52) to be fastened thereon. The gasket fixing seat (52) is fastened on the inner case (20) by means including, but not limited to those already known in the art, such as, compression locking, screwing, bonding and so forth to tightly fit the cap gasket (51) and the inner case (20). Moreover, a cavity (513) is centrally formed on a top of the cap gasket (51).

With further reference to FIG. 1, two buttons (60) are mounted above the inner case (20) to respectively cover the two recesses (22) of the inner case (20). The button (60) takes a rectangular form and has a pin (61) is extended downwardly from a front bottom surface of the button (60) to correspond to the cap gasket (51) in the recess (22) and is inserted into the cavity (513) on the top of the cap gasket (51). A slice of fixing portion (62) is extended from a rear end of the button (60). A second fixing hole (621) and two positioning holes (622) are formed on the fixing portion (62) and respectively correspond to the first fixing column (24) and the two positioning bosses (25) so that the fixing portion (62) can be fastened on the first fixing column (24). The two positioning bosses (25) respectively correspond to the two positioning holes (622) and are respectively inserted therein to further position the button (60).

Given the foregoing mechanism, a front end of the button (60) is movably suspended. When the front end of the button (60) is pressed down, the pin (61) on the bottom of the button (60) presses the cap gasket (51). Due to the elastic portion (510) formed on the outer periphery of the cap gasket (51), the cap gasket (51) is compressed. The cavity (513) of the cap gasket (51) is further pressed down by the pin (61) to contact with the respective actuation protrusion (410)(420) of the micro switch (41)(42). After the pressure on the button is released, the elastic portion (510) on the cap gasket (51) together with the front end of the button (60) restore the cap gasket (51) and button (60) to original positions. Since the disk portion (511) of the cap gasket (51) is always adhered to the front end of the recess (22) throughout the pressing and releasing operation of the button (60), the mounting holes (23) are completely sealed, thereby securing a complete sealing effect between the inner case (20) and the bottom case (10) and further enhancing the waterproof effect.

A space in the inner case (20) is formed between two recesses (22), serving to accommodate a touch-type third-axis control device (not shown).

Figure 4:
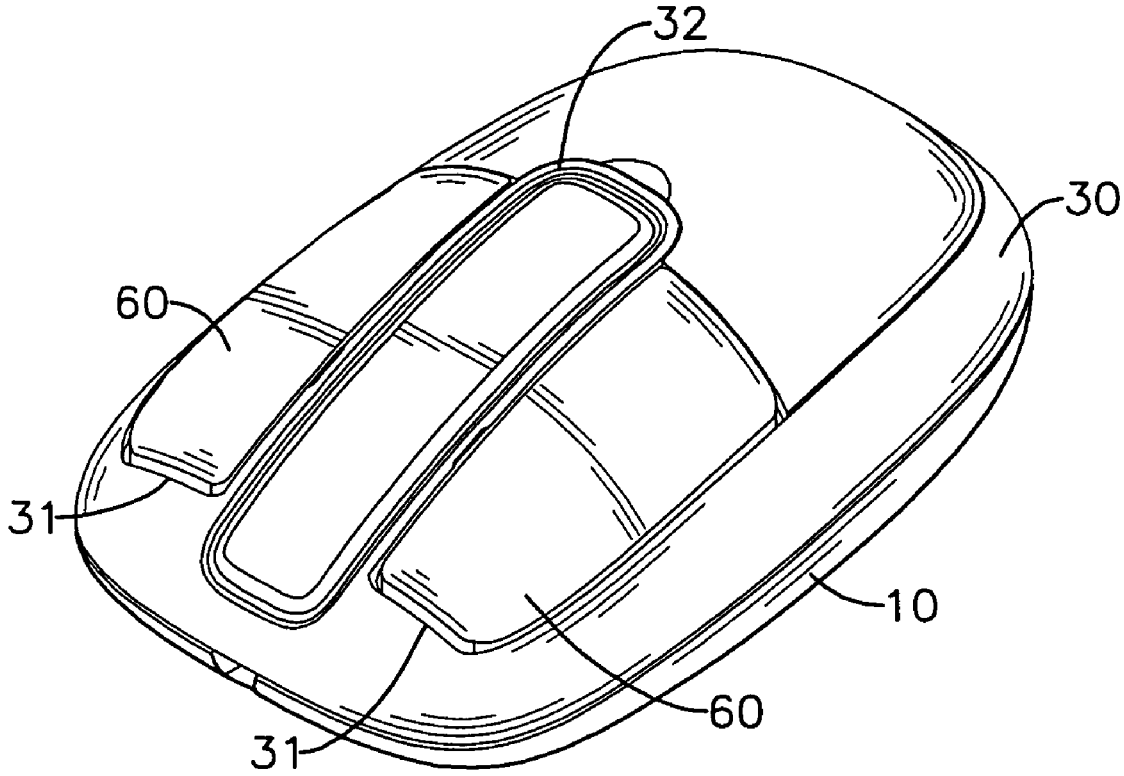
FIG. 4 is a perspective view of the first preferred embodiment of the waterproof button mechanism in accordance with the present invention.

With reference to FIGS. 1 and 4, the mouse further has a top cover (30) having a second opening whose inner perimeter matches an outer perimeter of the rib ring (110) located around the opening of the bottom case (10) for the top cover (30) to be connected with the bottom case (10) and to be located above the inner case (20). Two side slots (31) are formed through a front end of the top cover (30). A middle slot is formed through the front end of the top cover (30) and is located between the two side slots. The two side slots (31) respectively corresponding to the front ends of the two buttons, so the buttons are exposed and operated therein. The middle slot (32) corresponds to the third-axis control device on the inner case (20).

Figure 5:
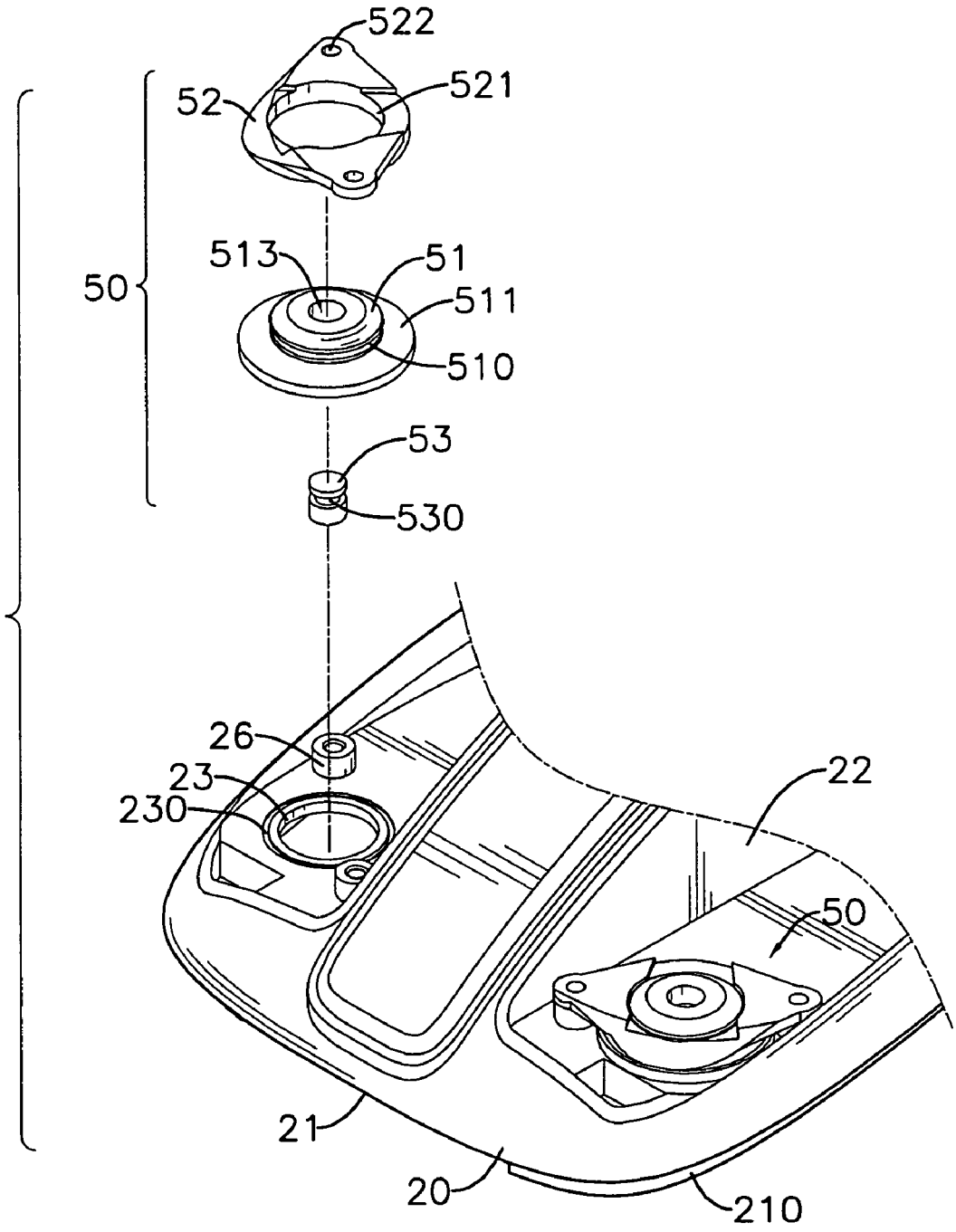
FIG. 5 is a partial exploded perspective view of a second preferred embodiment of the waterproof button mechanism in accordance with the present invention.
Figure 6:
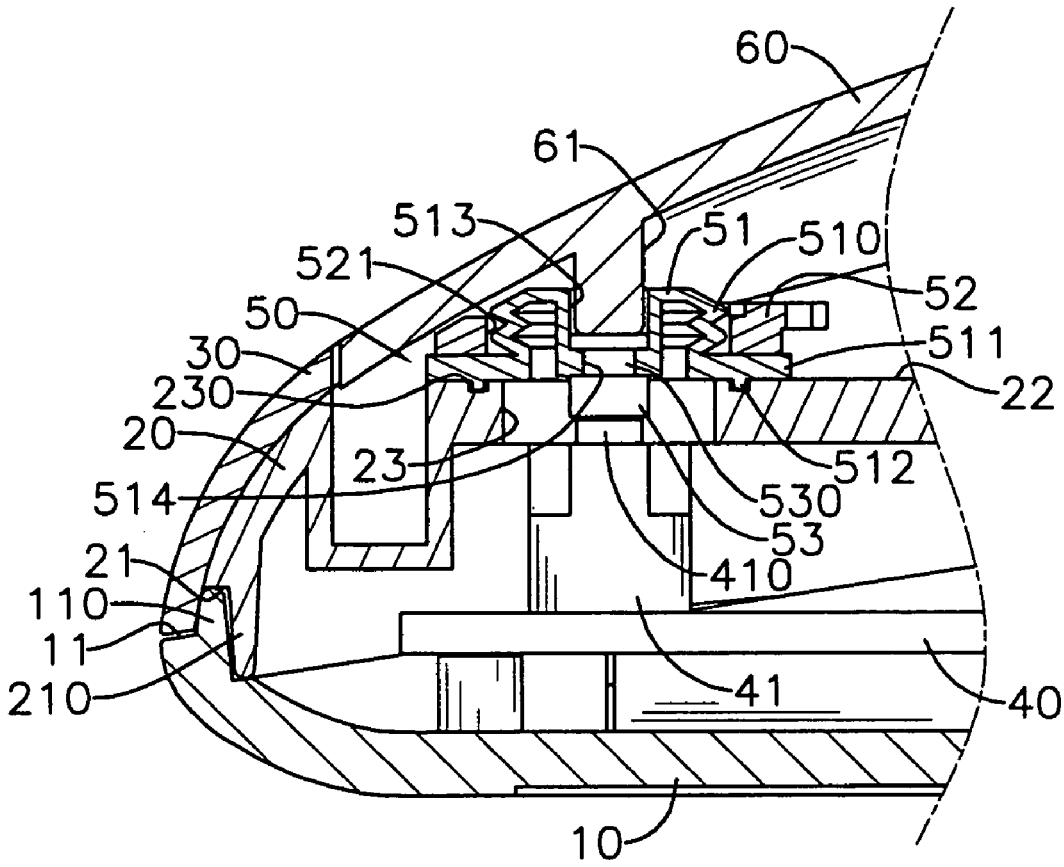
FIG. 6 is a partial cross-sectional view of the second preferred embodiment of the waterproof button mechanism in accordance with the present invention.
Figure 7:
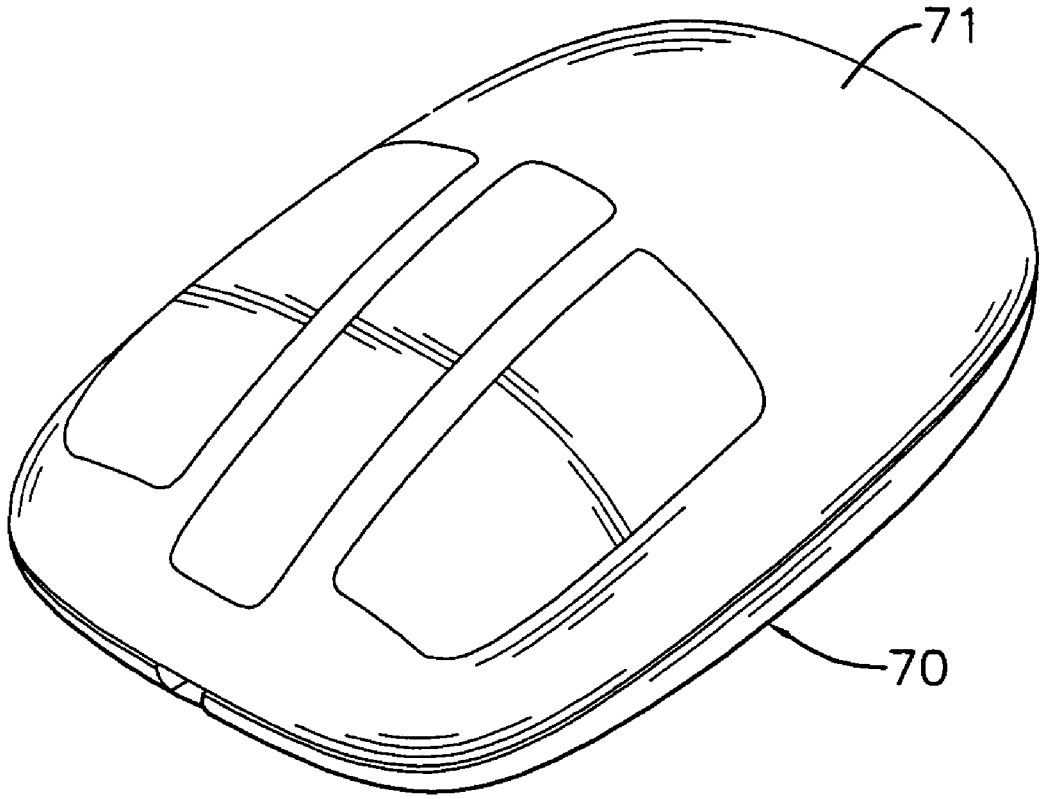
FIG. 7 PRIOR ART
FIG. 7 is a perspective view of a conventional waterproof computer input device.

With reference to FIGS. 5 and 6, a second embodiment of the present invention has a bottom case (10), an inner case (20) and a top cover (not shown). The mechanisms of the bottom case (10) and the inner case (20) are exactly the same as those in the first embodiment of the present invention. The first embodiment differs from the second embodiment in the waterproof assembly. In the present embodiment, the water assembly further has an actuator (53), which is mounted inside the cap gasket (51). One of the feasible mounting methods of the actuator (53) is described as follows:

As mentioned earlier, a cavity (513) is formed centrally on the top of the cap gasket (51). In the present embodiment, a through hole (514) is formed through a bottom of the cavity (512) for mounting the actuator (53). The outer diameter of the actuator (53) substantially matches the inner diameter of the cavity (513). A reduced neck (530) is formed on a top end of the actuator (53). The outer diameter of the reduced neck (530) just matches the diameter of the through hole (514). The cap gasket (51) is composed of an elastic material. When the actuator (53) passes through the through hole (514), the diameter of the through hole (514) is expanded. When the through hole (514) corresponds to the reduced neck (530) of the actuator (53), the diameter of the through hole (514) is restored, so that the elastic material clamps the reduced neck (530) and the actuator (53) is fixed on a bottom portion of the cap gasket (51). The two actuators (53) respectively correspond to the two actuation protrusions (410, 420) of the two micro switches (41, 42).

In addition to the aforementioned assembly method, the insert molding and double shoot molding can also be adopted to achieve more desirable water-sealing effect between the cap gasket (51) and the actuator (53).

With further reference to FIG. 6, the pin (61) on the front bottom surface of the button (60) is correspondingly inserted in the cavity (513) on the top of the respective cap gasket (51).

When users press down the front end of the button (60), the pin (61) pushes the actuator (53) down. Meanwhile, the cap gasket (51) is compressed as well. Because of the elastic portion (510) formed on the outer periphery, the cap gasket (51) exhibits a compressed state accordingly, and a bottom of the actuator (53) triggers the actuation protrusion (410)(420) of the respective micro switch (41)(42). Once the pressure on the front end of the button (60) is released, the elastic portion (510) of the cap gasket (51) accompanies the actuator (53) and the front end of the button (60) in recovering their original positions.

Even though numerous characteristics and advantages of the present invention have been set forth in the foregoing description, together with details of the mechanism and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A waterproof button mechanism of computer input device, comprising:

a bottom case having a first opening, a bottom edge formed around the first opening, and two micro switches mounted therein and located on a front end thereof;

an inner case having a second opening, an inner edge formed around the second opening to correspond to the bottom edge and connected with the bottom case, two mounting holes formed on a front end thereof and corresponding to two micro switches on the bottom case, and two waterproof assemblies respectively mounted to cover the two mounting holes and each having a cap gasket being resilient vertically and aligned to the corresponding micro switch thereunder; and two buttons movably mounted above the inner case and each having a front end corresponding to one of the respective cap gaskets on the inner case.

2. The waterproof button mechanism of computer input device as claimed in claim 1, wherein each of the cap gaskets comprises:

an elastic portion taking a form of a flexible pipe and formed on an outer periphery of a corresponding cap gasket, a disk portion horizontally and outwardly extended from a bottom of the corresponding cap gasket, wherein an outer diameter of the disk portion is greater than that of the corresponding mounting hole.

3. The waterproof button mechanism of computer input device as claimed in claim 2, wherein two annular grooves are respectively formed on outer peripheries of the mounting holes, and two waterproof rings are protruded downwardly and respectively from bottoms of the disk portions, wherein a height of each of the waterproof rings corresponds to a depth of a corresponding annular groove.

4. The waterproof button mechanism of computer input device as claimed in claim 3, wherein each of the two waterproof assemblies further comprises an eye-shaped gasket fixing seat, a bore is formed through the gasket fixing seat, a diameter of the bore matches the outer diameter of a corresponding cap gasket such that the corresponding cap gasket penetrates through the bore in an inner-to-outer direction, two recesses are formed on the inner case, the two mounting holes are respectively formed on front ends of the two recesses, two first fixing holes are respectively formed through two ends of the gasket fixing seat along a traverse axis thereof, and two fixing columns are respectively mounted on the recesses to abut the mounting holes therein and to respectively correspond to the two fixing holes on the gasket fixing seat.

5. The waterproof button mechanism of computer input device as claimed in claim 4, wherein each of the cap gaskets has a cavity centrally formed on a top of a corresponding cap gasket, and each of the buttons has a front bottom surface and a pin extended downwardly from the front bottom surface and corresponding to the corresponding cap gasket in the corresponding recess to insert in the cavity of the top of the corresponding cap gasket.

6. The waterproof button mechanism of computer input device as claimed in claim 5, wherein each of the two waterproof assemblies further comprises an actuator mounted on the bottom of the corresponding cap gasket.

7. A computer input device, comprising:

a bottom case having at least one micro switch mounted thereon;

an inner case mounted on the bottom case and having at least one mounting hole thereon, each of the at least one mounting hole corresponding to one of the at least one micro switch, and at least one waterproof gasket, each of the least one waterproof gasket mounted on a corresponding mounting hole and having a cavity; and a top lid having at least one button, each of the least one button having a pin;

wherein the pin of each of the at least one button is inserted in the cavity of a corresponding waterproof gasket, and when each of the at least one button is pressed down, the pin of each of the at least one button presses a bottom of the corresponding waterproof gasket to trigger the corresponding micro switch.

8. The computer input device as claimed in claim 7, wherein each of the at least one waterproof gasket has an elastic portion.

9. The computer input device as claimed in claim 7, further comprising at least one actuator, each of the at least one actuator mounted in the cavity of a corresponding waterproof gasket, and the pin of each of the at least one button is pressed down to press the corresponding actuator to trigger the corresponding micro switch.

10. The computer input device as claimed in claim 8, further comprising at least one actuator, each of the at least one actuator mounted in the cavity of a corresponding waterproof gasket, and the pin of each of the at least one button is pressed down to press the corresponding actuator to trigger the corresponding micro switch.

11. The computer input device as claimed in claim 7, further comprising at least one gasket fixing seat, each of the least one gasket fixing seat mounted on the corresponding mounting hole and has a bore to receive the corresponding waterproof gasket.

12. The computer input device as claimed in claim 11, wherein each of the least one gasket fixing seat is fastened on the inner case so that the corresponding waterproof gasket seals the corresponding mounting hole.

* * * * *